US009364948B1

(12) United States Patent
Rudnick et al.

(10) Patent No.: US 9,364,948 B1
(45) Date of Patent: Jun. 14, 2016

(54) ADJUSTABLE HOLDER ASSEMBLY FOR PAINTING TOOLS

(71) Applicants: Eric Rudnick, Pinetop, AZ (US); Chad Prosser, Pinetop, AZ (US)

(72) Inventors: Eric Rudnick, Pinetop, AZ (US); Chad Prosser, Pinetop, AZ (US)

( * ) Notice: Subject to any disclaimer, the term of this patent is extended or adjusted under 35 U.S.C. 154(b) by 0 days.

(21) Appl. No.: 14/628,961

(22) Filed: Feb. 23, 2015

Related U.S. Application Data

(63) Continuation of application No. 13/452,634, filed on Apr. 20, 2012, now Pat. No. 8,959,698.

(51) Int. Cl.
*A46B 7/02* (2006.01)
*B25G 3/38* (2006.01)
*B05C 17/02* (2006.01)

(52) U.S. Cl.
CPC ..... *B25G 3/38* (2013.01); *B05C 17/022* (2013.01)

(58) Field of Classification Search
CPC ..... B25G 3/38; B25G 3/26; B05C 17/022; A46B 5/0075; A46B 5/0083
See application file for complete search history.

(56) References Cited

U.S. PATENT DOCUMENTS

| | | | | |
|---|---|---|---|---|
| 4,525,889 | A | 7/1985 | Dunau | |
| 5,123,768 | A | 6/1992 | Franklin | |
| 5,207,755 | A * | 5/1993 | Ampian | 15/230.11 |
| 5,502,859 | A | 4/1996 | Kim | |
| 6,128,800 | A | 10/2000 | Vosbikian | |
| 7,178,191 | B2 | 2/2007 | Hitzler | |
| 7,770,252 | B2 * | 8/2010 | Errichiello et al. | 15/172 |
| 7,854,037 | B2 | 12/2010 | Lu | |
| 2002/0148057 | A1 | 10/2002 | Hobden | |
| 2006/0191088 | A1 | 8/2006 | Goulet et al. | |
| 2007/0226935 | A1 | 10/2007 | Lu | |
| 2010/0183362 | A1 | 7/2010 | Franklin et al. | |

FOREIGN PATENT DOCUMENTS

GB 806597 A 12/1958

OTHER PUBLICATIONS

Joseph Truini, 12 Wacky Painting Tools You Never Thought You'd Need: DIY Guy, Popular Mechanics, Oct. 1, 2009; http://www.popularmechanics.com/home/improvement/4284876.

* cited by examiner

*Primary Examiner* — Shay Karls
(74) *Attorney, Agent, or Firm* — Booth Udall Fuller, PLC

(57) ABSTRACT

An adjustable holder assembly for removably holding, articulating, and rotating painting tools may include a handle assembly. An articulating arm may be pivotally coupled to a proximal end of the handle assembly and may be configured to allow both the articulating arm and a tool handle housing to be simultaneously angularly adjusted from a longitudinal axis of the holder assembly to any position from 0 degrees to 90 degrees. The tool handle housing may be configured to removably secure a handle of a painting tool at least partially therein. The tool handle housing may be removably coupled to the articulating arm such that the tool handle housing can be rotationally adjusted around a longitudinal axis of the holder assembly to any position from 0 degrees to 90 degrees; and a receiver end defining a channel.

13 Claims, 11 Drawing Sheets

ADJUSTABLE HOLDER ASSEMBLY FOR PAINTING TOOLS

CROSS REFERENCE TO RELATED APPLICATIONS

This application is a continuation application of the earlier U.S. Utility Patent Application to Eric Rudnick, et. al. entitled "Adjustable Holder Assembly For Painting Tools," application Ser. No. 13/452,634, filed Apr. 20, 2012, now U.S. Pat. No. 8,959,698, the disclosure of which being hereby incorporated entirely herein by reference.

BACKGROUND

1. Technical Field

This document relates to an adjustable holder assembly for painting tools.

2. Background

Many hand tools are commonly furnished with handles or handle extensions that are rigidly attached to the tool head. Often it is necessary to work with the tool in a position which is awkward for the user or which prevents the user from applying the desired amount of force or movement to the tool. Some tools can be attached to an extension pole, but typically such a connection results in expensive mistaken strokes and occasional decoupling causing a dropped tool.

SUMMARY

Aspects of this document relate to an adjustable holder assembly for painting tools. These aspects may comprise, and implementations may include, one or more or all of the components and steps set forth in the appended CLAIMS, which are hereby incorporated by reference.

In one aspect, an adjustable holder assembly for removably holding, articulating, and rotating painting tools is disclosed. The assembly may include a handle assembly. An articulating arm may be pivotally coupled to a proximal end of the handle assembly and may be configured to allow both the articulating arm and a tool handle housing to be simultaneously angularly adjusted from a longitudinal axis of the holder assembly to any position from 0 degrees to 90 degrees. The articulating arm may include: an adjustable end defining a central through hole and a rounded corner with a plurality of notches defined radially in and edge thereof with respect to the central through hole; and a first sleeved end defining a first inward directing cavity for both removably and rotatably receiving therein a second sleeved end of a tool handle housing. The tool handle housing may be configured to removably secure a handle of a painting tool at least partially therein. The tool handle housing may be removably coupled to the articulating arm and may include: a second sleeved end removably and rotatably inserted into the sleeved end of the articulating arm such that the tool handle housing can be rotationally adjusted around a longitudinal axis of the holder assembly to any position from 0 degrees to 90 degrees; and a receiver end defining a channel. An adjustment assembly may be coupled to a top of the receiver end and may include an engaging member in the channel to removably secure a handle of a painting tool at least partially within the receiver end.

Particular implementations may include one or more or all of the following.

The handle assembly may include a top handle housing coupled to a bottom handle housing.

A rocker switch assembly may be provided that includes: a push button trigger coupled in a recess defined in a top surface of the top handle housing via a spring pin; a spring coupled beneath a distal end of the push button trigger that biases the push button trigger in an engaged position with the articulating arm to prevent inadvertent adjustment; and a locking plate coupled to an underside of a proximal end of the push button trigger, the locking plate removably engaging with the plurality of notches as the push button trigger depresses and releases the spring to adjust and then hold articulating arm in different adjustment positions.

The proximal ends of the top and the bottom handle housings together may form a through channel shaped recess and the distal free ends of the top and the bottom handle housings together may form an inward directing cavity for receiving therein an end of an extension pole.

The adjustable end of the articulating arm may be sandwiched between the proximal ends of the top and the bottom handle housings within the through channel shaped recess.

A sleeve may be provided that slides over a coupling joint of distal ends of the top and the bottom handle housings and an extension pole to help keep that joint secure and the distal ends of the top and the bottom handle housings from separating away from each other when an end of an extension pole is coupled therein.

An adjustment assembly may be coupled to the top handle housing for securing an end of an extension pole within the inward directing cavity formed by the distal free ends of the top and the bottom handle housings.

The adjustable end of the articulating arm may be substantially rectangular in shape and may also include first and second flat stopping surfaces on either side of the rounded corner configured to prevent further articulation of the articulation arm as they abut a bottom surface of the through channel shaped recess formed in the proximal end of the handle assembly.

The handle assembly may include a generally cylindrical configuration.

The plurality of notches may include at least four notches configured to allow painting tool handle housing to be angularly adjusted to at least a 0 degree position, a 30 degree position, a 60 degree position, and a 90 degree position, respectively.

The receiver end may include both a partially open top and a partially open bottom.

The channel may include a U-shaped cross-sectional shape with angled internal corners.

The adjustment assembly may include a handle pad disposed within the channel and coupled to an adjustment knob via an adjustment screw, the handle pad configured to removably retain handles of tools at least partially within the channel.

A plurality of surface ridges and grooves may be included on at least a bottom surface of the channel to securely grip handles to keep them in position and prevent them from slipping or turning. The surface ridges and grooves may be aligned longitudinally with the channel.

The first sleeved end may define through a surface thereof first and second adjustment through holes and a retention through slot. The second sleeved end may define through a surface thereof opposing and offset through holes and defines a second inward directing cavity. The adjustable holder assembly may include a snap button configured to couple the articulating arm to the tool handle housing. The snap button may include a resilient, Z-shaped member having two opposing and offset from one another hemispherical projections. The snap button may be inserted and received into the inward directing cavity defined by the second sleeved end such that the hemispherical projections are removably engaged through the corresponding opposing and offset through holes and the corresponding retention through slot and one of the first and second adjustment through holes.

In another aspect, an adjustable holder system for removably holding, articulating, and rotating painting tools is disclosed. The system may include an adjustable holder assembly as previously just described. A painting tool may include a handle and the handle may be removably retained at least partially within the channel by the engaging member.

Particular implementations may include one or more or all of the following.

The handle may be held in a horizontal orientation within the channel.

The painting tool may be a paint brush, brush, a paint roller, a paint pad, or a paint shield.

The foregoing and other aspects, features, and advantages will be apparent to those of ordinary skill in the art from the DESCRIPTION and DRAWINGS, and from the CLAIMS.

BRIEF DESCRIPTION OF DRAWINGS

Implementations will hereinafter be described in conjunction with the appended DRAWINGS (which are not necessarily to scale), where like designations denote like elements.

DESCRIPTION

Figure 1:
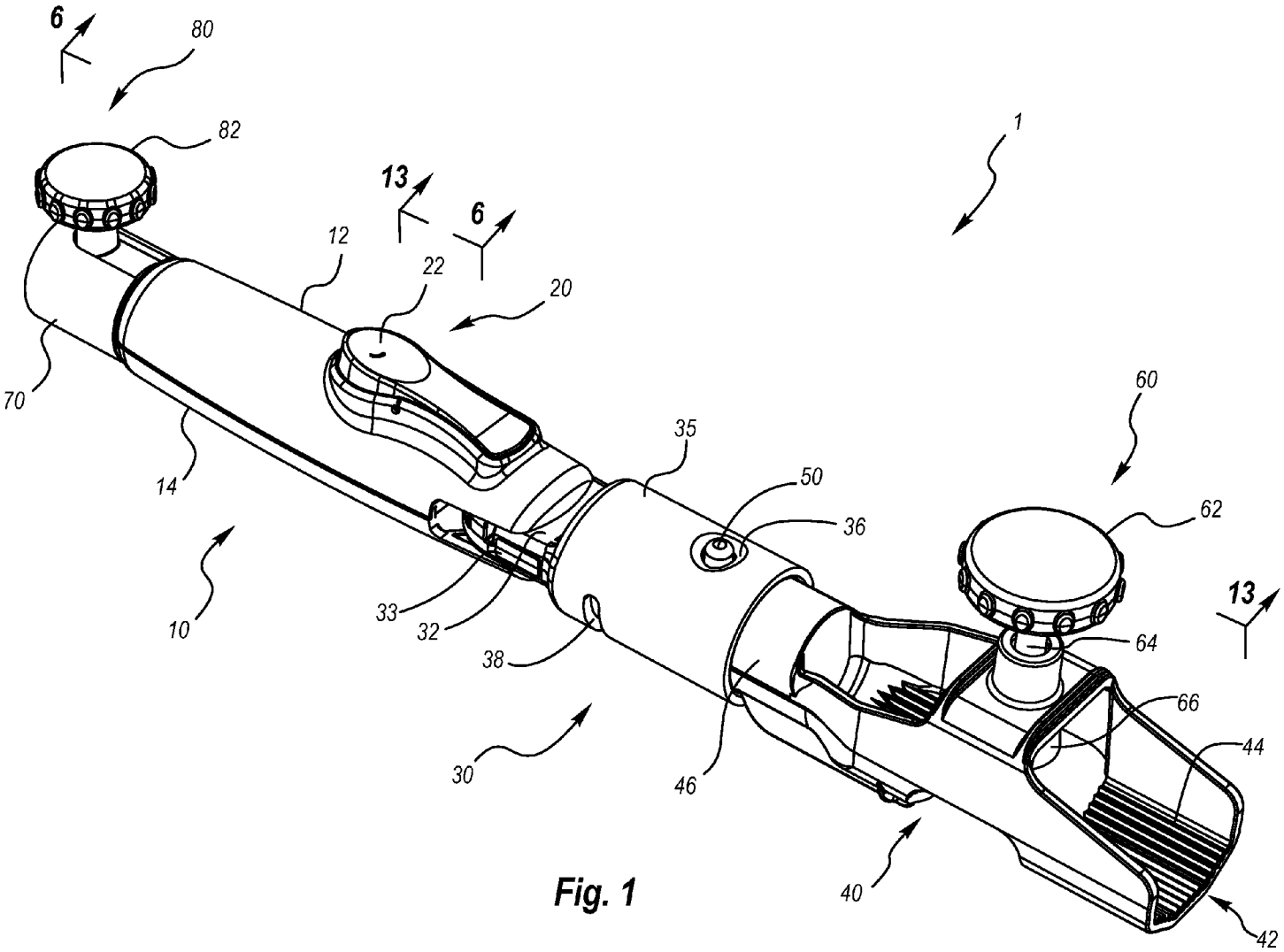
FIG. 1 is a top, left perspective view of an implementation of an adjustable holder assembly for painting tools.

This document features implementations of an adjustable holder assembly for painting tools. There are many features of adjustable holder assembly implementations disclosed herein, of which one, a plurality, or all features or steps may be used in any particular implementation.

In the following description, reference is made to the accompanying DRAWINGS which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure.

Structure

There are a variety of implementations of an adjustable holder assembly that provide for removably holding, articulating, and/or rotating various painting tools, such as paint brushes, paint rollers, paint pads, paint shields, and the like to detachable handles or extension rods. They are designed to be taken apart and cleaned with solvents since the nature painting leads to painting tolls with paint build up over time.

Adjustable holder assemblies for painting tools provide an ergonomic assembly that interchangeably receives different sized painting tools. Adjustable holder assemblies can provide both angular and rotational movement of a painting tool (move to a plurality of articulated and/or rotated positions) so that a painter can customize the positioning of the holder assembly based upon the configuration of the surface to be painted and the access to that surface. For example, if the surface is a distance away from a painter, like overhead moldings, trim pieces, fixtures, corners, and the like for example, an extension pole or rod can be coupled at one end of the holder assembly and a paint brush for example can be coupled at the other end and adjusted both angularly and rotationally to ensure proper positioning and to facilitate even application of the paint.

Notwithstanding, turning to FIGS. 1-5, 7-8, and 12-14, and for the exemplary purposes of this disclosure, adjustable holder assembly 1 for painting tools is shown. In this implementation, adjustable holder assembly 1 is an adjustable paint brush holder assembly. Adjustable holder assembly 1 generally includes handle assembly 10, rocker switch assembly 20, articulating arm 30, painting tool handle housing 40, snap button 50, adjustment assembly 60, sleeve 70, and adjustment assembly 80.

Handle assembly 10 may include a top handle housing 12 and a bottom handle housing 14 that may be removably or permanently coupled together. Top and bottom handle housings 12 and 14 combine to provide the handle assembly 10 with a generally cylindrical configuration that a painter can grasp.

For example, as depicted, each end of bottom handle housing 14 has attachment through holes running through internal sleeve members and each internal end of top handle housing 12 defines corresponding receiving holes that extend inward from an opening that align with the through holes/internal sleeves in bottom handle housing 14. These holes are configured to receive there through or therein as the case may be an elongated fastener such as screw 130 (e.g. pan head machine screw) and a through-threaded insert 120, thereby coupling the two housing 12 and 14 halves together.

The proximal ends of top and bottom handle housings 12 and 14 together form a through channel shaped recess. Top and bottom handle housings 12 and 14 proximal ends are configured to couple articulating arm 30 within this recess as explained below.

Their distal free ends are configured to couple with an extension pole 110 for example. In particular, their distal free ends combine to form an inwardly directed cavity for receiving therein an end of an extension pole. Their distal free ends can be internally threaded along a longitudinal axis of holder assembly 1 and when combined form an inwardly directed threaded cavity for receiving therein a threaded end of extension pole 110.

Sleeve 70 may also be included that slides over the coupling joint of the distal ends of housings 12 and 14 and extension pole 110 to help keep that joint secure and the ends of distal ends of housings 12 and 14 from separating away from each other when an end of an extension pole is coupled therein. Sleeve 70 may include hole 71 and pin 72 to couple sleeve 70 to an end of an extension pole 110 when installed.

Also included is an adjustment assembly 80 that also helps to secure the end of extension pole 110 within the cavity formed by the distal free ends of housings 12 and 14 so the holding assembly 10 does not rotate about extension pole 110 for example when a painter is using the assembly 1 with a paint brush 100 for example to paint a surface (tends to spin an unloosen), and, therefore, defeat the purpose have having an adjustable holder assembly in the first place. Rotary control knob 82 is coupled to adjustment screw 84 which extends through through-threaded insert 120 within top housing 12 and adjustably contacts and presses against the end of extension pole 110 to retain it within the cavity.

Rocker switch assembly 20 includes a push button trigger 22 coupled in a recess defined in the top surface of top handle housing 12 via a spring pin 28 that removably engages with notches 34 in an edge of adjustable end 32 of articulating arm 30 so that the arm 30 can be moved and locked in any number of positions (e.g., at least four different positions between 0 to 90 degrees for example as explained further below). Spring 26 is coupled beneath one end of push button 22 and biases push button 22 in an engaged position with articulating arm 30 to prevent inadvertent adjustment. Locking plate 24 is coupled to the underside of the opposite end of push button 22 and removably engages/interfaces or disengages with notches 34 as push button 22 depresses and releases spring 26 to adjust and then hold articulating arm 30 in a particular adjustment position.

Figure 4:
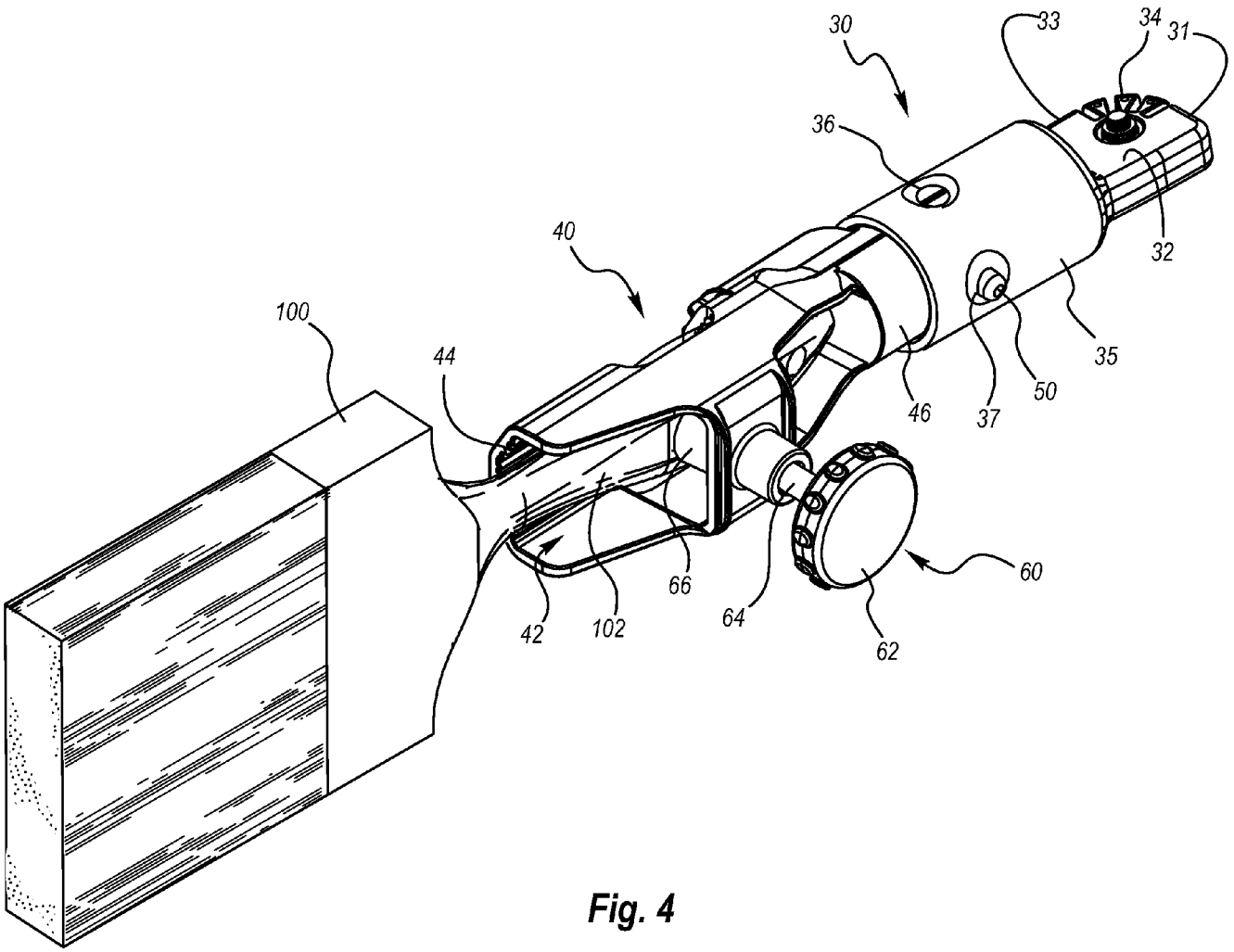
FIG. 4 is a top, right perspective view of the adjustable holder system of FIG. 2 including the adjustable holder assembly of FIG. 1 in a second rotated position removably coupled with a painting tool.
Figure 5:
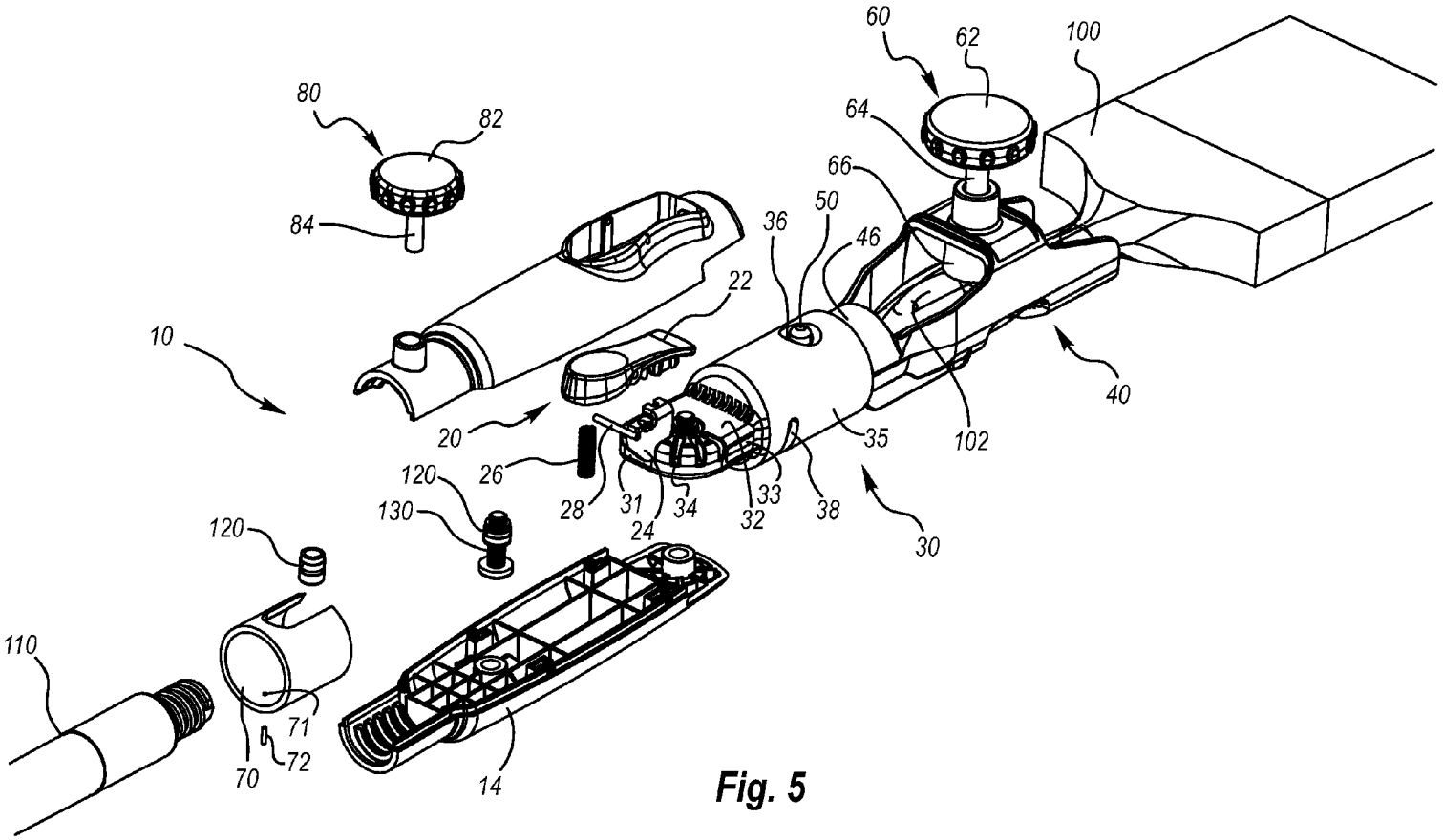
FIG. 5 is a top, back exploded perspective view of the adjustable holder assembly of FIG. 1 in the adjustable holder system of FIG. 2.
Figure 7:
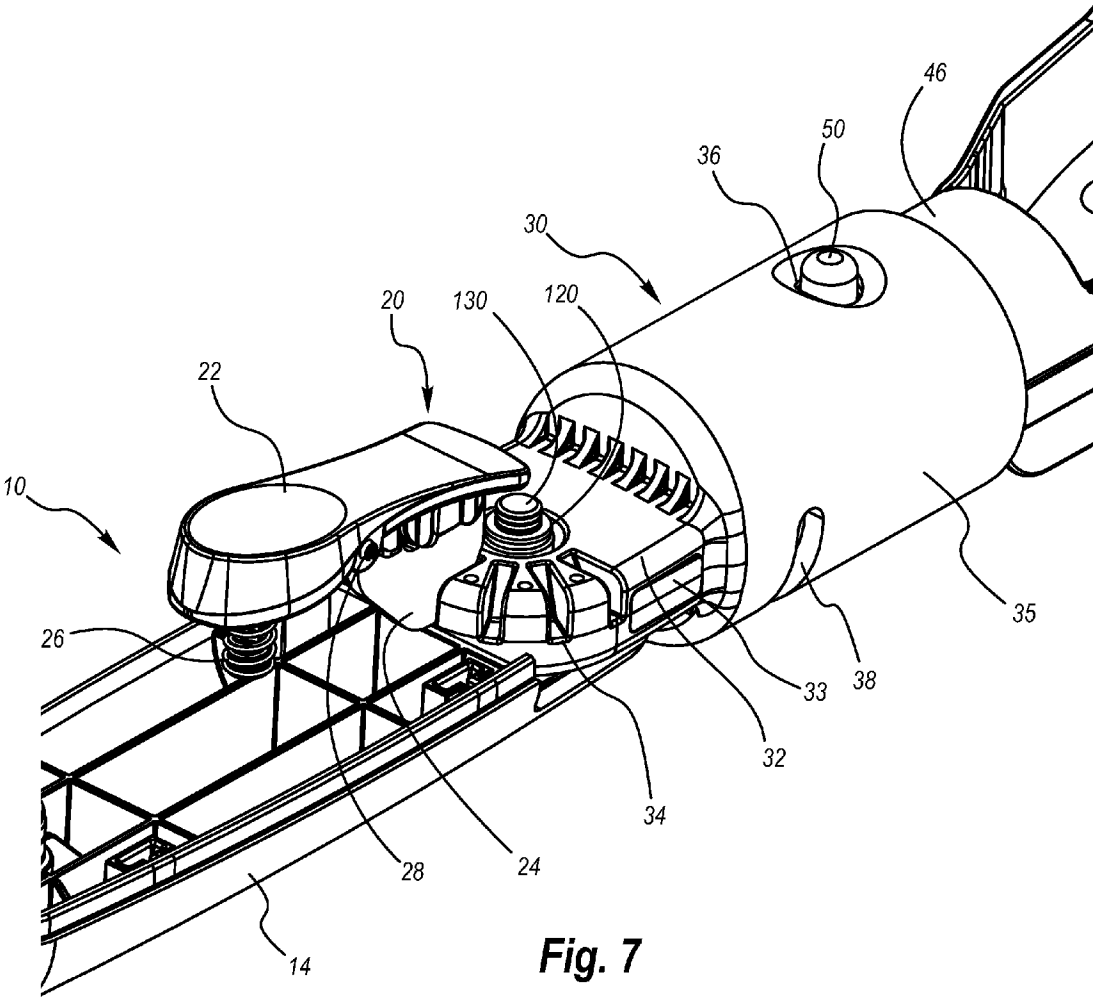
FIG. 7 is a top, back broken-away perspective view of the adjustable holder assembly of FIG. 1 with the top handle housing removed to show the interaction of the rocker switch assembly with the articulating arm in a first articulated position.
Figure 8:
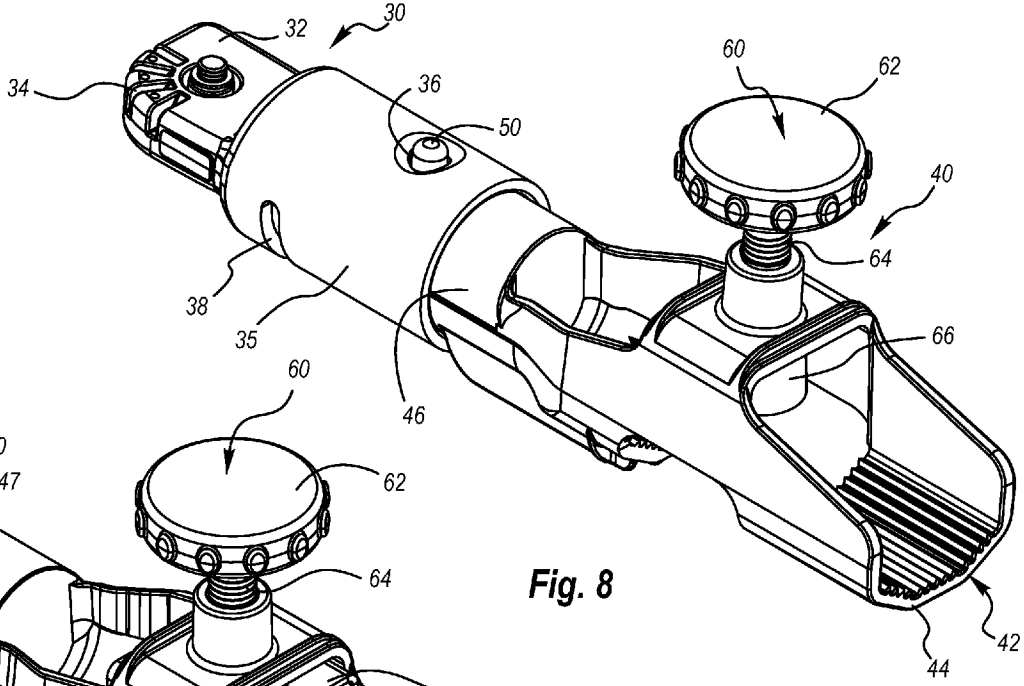
FIG. 8 is a top, left perspective view of the articulating arm and the painting tool handle housing of the adjustable holder assembly of FIG. 1.

Articulating arm 30 adjustably couples painting tool handle housing 40 to handle assembly 10. As best seen in FIGS. 4 and 7, articulating arm 30 includes adjustable end 32 which may be substantially rectangular in shape defining a central through hole, flat stopping surfaces 31 and 33, and a rounded corner with notches 34 defined radially in the rounded corner with respect to the central through hole. Thus, painting tool handle housing 40 can be angularly adjusted from a longitudinal axis of holder assembly 1 to any position from 0 degrees to 90 degrees. Stopping surfaces 31 and 33 prevent further articulation of articulation arm 30 as they abut the bottom surface of the through channel shaped recess formed by the proximal ends of housings 12 and 14. Alternatively, the both corners of adjustable end 32 could be rounded (e.g., semi-circular in shape) with notches 34 defined radially in the rounded corners with respect to the central through hole, thereby allowing for example articulation or angular adjustment between 0 degrees to 180 degrees.

Articulating arm 30 is pivotally coupled to the proximal ends of top and bottom handle housings 12 and 14 of handle assembly 10. Specifically, adjustable end 32 of articulating arm 30 is sandwiched between the proximal ends of top and bottom handle housings 12 and 14 within the through channel shaped recess formed by the proximal ends of housings 12 and 14 (in a type of tongue and groove arrangement for example). This arrangement may form a revolute joint for example with the base being handle assembly 10 and the follower being articulating arm 30 and the axis of rotation running through the aligning holes and through hole 34. The through hole 34 receives therein the internal sleeve member of the bottom handle housing 14 so that it is aligned with the attachment through hole running through the internal sleeve member and aligned with the internal hole in top handle housing 12. Screw 130 is engaged through the aligning holes and thereby with the internal sleeve member bushing type engagement with through hole 34 to form the pivotal coupling of handle assembly 10 to articulating arm 30.

Articulating arm 30 also includes sleeved end 35 that defines through a surface thereof adjustment through holes 36 and 37 and retention through slot 38 for receiving snap button 50. Sleeved end 35 also defines an inward directing cavity for both removably and rotatably receiving therein sleeved end 46 of painting tool handle housing 40 as explained below. Sleeved end 35 and the cavity it defines may be cylindrical and circular in cross-section for example.

As depicted in the figures, articulating arm 30 allows painting tool handle housing 40 to be angularly adjusted from a longitudinal axis of holder assembly 1 to any position from 0 degrees to 90 degrees, though as explained above articulation or angular adjustment between 0 degrees to 180 degrees could just as easily be allowed. Notwithstanding and for example, as depicted, articulating arm 30 can allow painting tool handle housing 40 to be angularly adjusted to four positions—0 degrees, 30 degrees, 60 degrees, and 90 degrees for example. Obviously, articulating arm 30 could be configured to allow painting tool handle housing 40 to be angularly adjusted to more or less than four positions at any combination and number of angular positions as previously described. Such angular movement allows a painter to adjust the painting tool handle housing 40 and hence a painting tool to positions between 0 and 90 degrees or even positions between 0 and 180 degrees. This allows the painter to angularly position and adjust a painting tool to facilitate application of paint to a surface.

Painting tool handle housing 40 is configured to removably secure a handle of a painting tool like handle 102 of paint brush 100 at least partially within housing 40 so that it does not slip or rotate or fall out. Painting tool handle housing 40 may be coupled to articulating arm 30. Specifically, one end of painting tool handle housing 40 includes sleeved end 46 which defines through a surface thereof opposing and offset through holes 47 and 48 as well as defines an inward directing cavity for receiving therein snap button 50 as explained below. Sleeved end 46 and the cavity it defines may be cylindrical and circular in cross-section for example. Sleeved end 46 can be inserted into sleeved end 35 of articulating arm.

The other end of painting tool handle housing 40 includes a receiver 42 and an adjustment assembly 60 having an engaging member 66 in the receiver 42 to removably secure a handle of a painting tool like handle 102 of paint brush 100 at least partially within housing 40.

The receiver 42 can define a channel. The channel can have both a partially open top and a partially open bottom. The channel may have a U-shaped cross-sectional shape with the internal corners beveled or angled. Such a configuration may more easily accommodate various sized handles. As such, a handle is held in a horizontal orientation within the channel. Such a configuration provides a simple one part design and a low profile.

Also included on at least a bottom surface of receiver 42 may be a plurality of surface ridges and grooves 44 to securely grip handles to keep them in position and prevent them from slipping or turning. The surface ridges and grooves 44 can be integrally defined in the surface of receiver 42 or they may be provided as an insert that is coupled therein. The surface ridges and grooves 44 can be aligned longitudinally with the receiver 42.

Opposite the surface ridges and grooves 44 is adjustment assembly 60 which is coupled to a top of receiver 42. Adjustment assembly 60 also helps to secure the handle of a painting tool within receiver 42 so that it does not inadvertently fall out in use. Rotary control knob 62 is coupled to adjustment screw 64 which extends into receiver 42 and is coupled to an engaging member 66. As rotary control knob 62 is rotated in a clockwise direction, engaging member 66 adjustably contacts and presses against a handle of a painting tool inserted into receiver 42 sandwiching the handle to retain it within receiver 42 so that it does not slip or twist. The engaging member 66 may be a cylindrically shaped pad. When the handle of the painting tool inserted into receiver 42 needs to be removed, rotary control knob 62 is rotated in a counterclockwise direction so that engaging member 66 releases from the handle.

Snap button 50 rotationally couples articulating arm 30 to painting tool handle housing 40. Snap button 50 allows painting tool handle housing 40 to be rotationally adjusted around a longitudinal axis of holder assembly 1 to any position from 0 degrees to 90 degrees (and hence a painting tool from a horizontal orientation to a vertical orientation for example). Notwithstanding and for example, as depicted, snap button 50 can allow painting tool handle housing 40 to be rotationally adjusted to two positions—0 degrees and 90 degrees for example. Obviously, snap button 50 could be configured to allow painting tool handle housing 40 to be rotationally adjusted to more or less than two positions at any combination and number of rotational positions. Such rotational movement allows a painter to adjust the painting tool handle housing 40 and hence a painting tool to positions between 0 and 90 degrees. This allows the painter to rotationally position and adjust (in addition to angularly positioning and adjusting) a painting tool to facilitate application of paint to a surface, such as remote overhead trim and the like.

Specifically, snap button 50 may be resilient and Z-shaped so that it behaves like a spring. It may be formed of spring steel for example. Snap button 50 may include two opposing and offset from one another (at each end of the Z) hemispherical projections. Snap button 50 may be inserted and received into the cavity defined by sleeved end 46 such that the hemispherical projections are removably engaged through the corresponding through holes 47 and 48.

As sleeved end 46 is inserted into the cavity of sleeved end 35, the hemispherical projections are forced inwards either by the painter or by the opening of the cavity thereby compressing snap button 50 so that sleeved end 46 can be slidably inserted. When the hemispherical projections reach their respective corresponding slot 38 and one of hole 36 and 37, snap button 50 springs back and the hemispherical projections protrude through and engage in their respective corresponding slot 38 and one of hole 36 and 37.

Retention slot 38 is optional of course, as is one hemispherical projection of snap button 50, and thus snap button 50 could be V-shaped with only one hemispherical projection on one end thereof. However, the benefit of retention slot 38 is its function as a guide and to help keep housing 40 from accidentally separating from articulating arm 30. That is, as one hemispherical projection slides along in slot 38 it allows for consistent engagement of the other hemispherical projection into hole 36 or 37 as housing 40 is rotated with respect to articulating arm 30. There is no guesswork by a painter or "finding" a hole. Retention slot 38 also by its configuration provides a stop at each end that corresponds to the locations of holes 36 and 37. That is, when the hemispherical projection that is sliding along in retention slot 38 reaches one end of slot 38, the hemispherical projection at the other end of snap button 50 is automatically aligned with one of the holes 36 or 37; when it reaches the other end of slot 38 the other projection is automatically aligned with the other hole 36 or 37. Retention slot also prevents sleeved end 46 from sliding up and down within sleeved end 35 as housing 40 is rotated with respect to articulating arm 30 so that again there is consistent engagement of the other hemispherical projection into hole 36 or 37.

Additional Implementations

Many additional implementations are possible.

Figure 6:
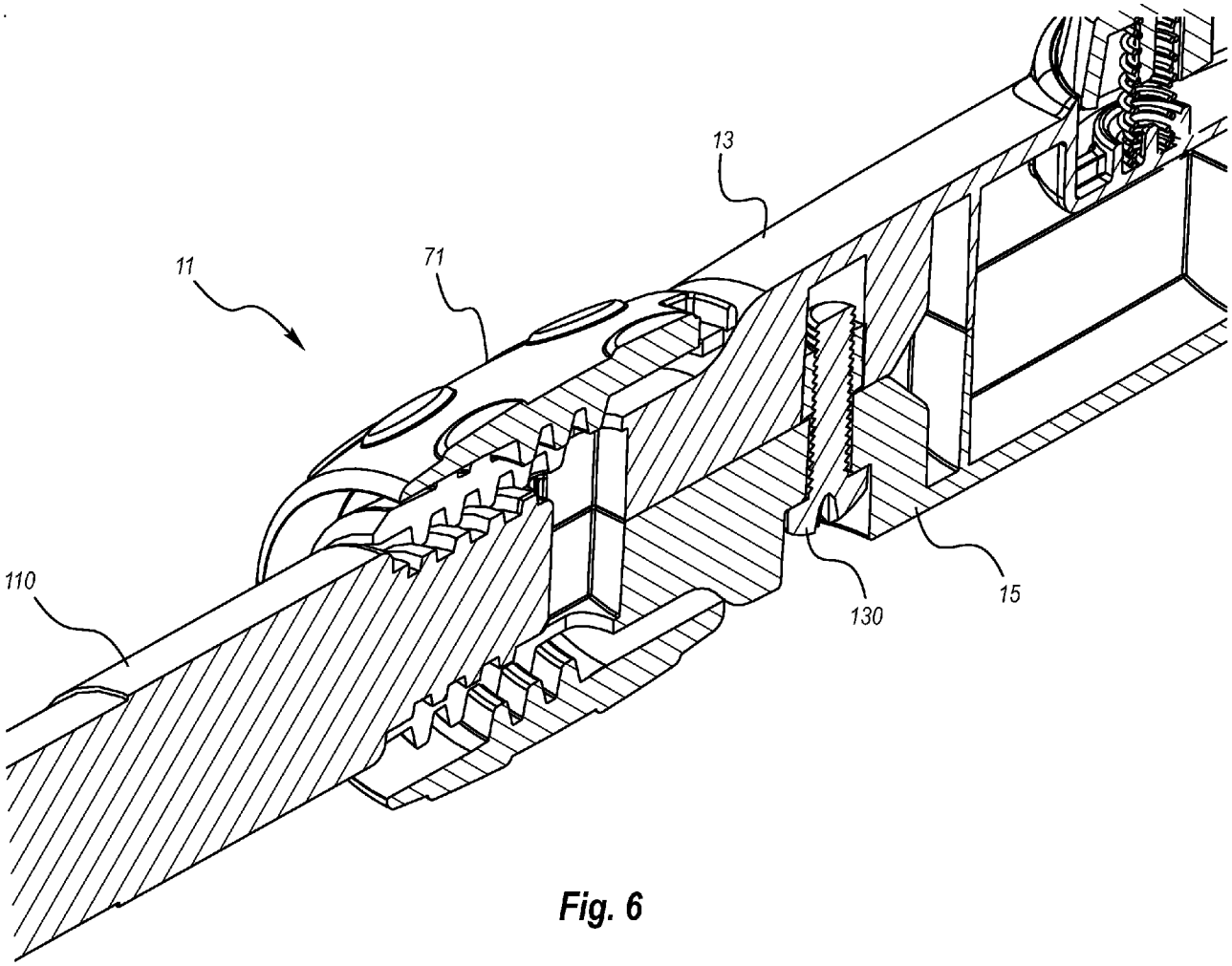
FIG. 6 is a cross-sectional view taken along line 6-6 of FIG. 1 showing a variation of a handle assembly of the adjustable holder assembly of FIG. 1.

For the exemplary purposes of this disclosure, FIG. 6 shows a cross-sectional view taken along line 6-6 of FIG. 1 showing a variation of a handle assembly of adjustable holder assembly 1. Handle assembly 11 is similar to handle assembly 10 as previously described. The principal difference is top and bottom housings 13 and 15 and adaptor 71. Top and bottom housing ends 13 and 15 are flared slightly and both internally and externally threaded. Adaptor 71 is a compression sleeve that is configured to join an extension pole 110 to the threaded ends of top and bottom housings 13 and 15. Adaptor 71 includes internal threads that are received by external threads of the threaded ends of top and bottom housings 13 and 15. The internal threaded ends of top and bottom housings 13 and 15 receive the threaded end of extension pole 110. Adaptor 71 is tightened down to keep the ends of top and bottom housings 13 and 15 together and eliminate the possibility of extension pole 110 loosening during use.

Figure 9:
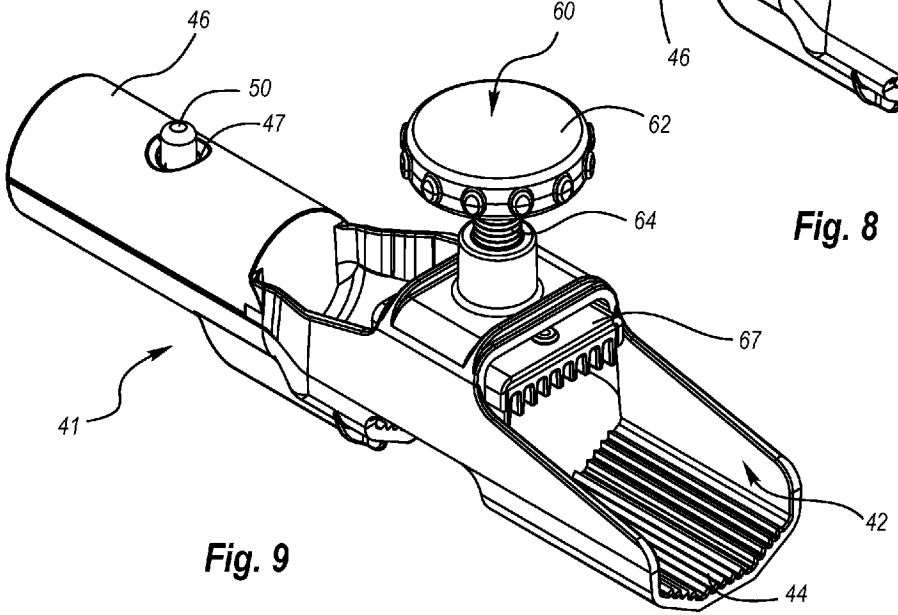
FIG. 9 is a is a top, left perspective view of a variation of a painting tool handle housing of the adjustable holder assembly of FIG. 1.

For the exemplary purposes of this disclosure, FIG. 9 shows a top, left perspective view of a variation of a painting tool handle housing of adjustable holder assembly 1. Painting tool handle housing 41 is similar to painting tool handle housing 40 as previously described. The principal difference is engaging member 67. Engaging member 67 includes surface ridges and grooves similar to surface ridges and grooves 44 to securely grip handles to keep them in position and prevent them from slipping or turning.

Figure 10:
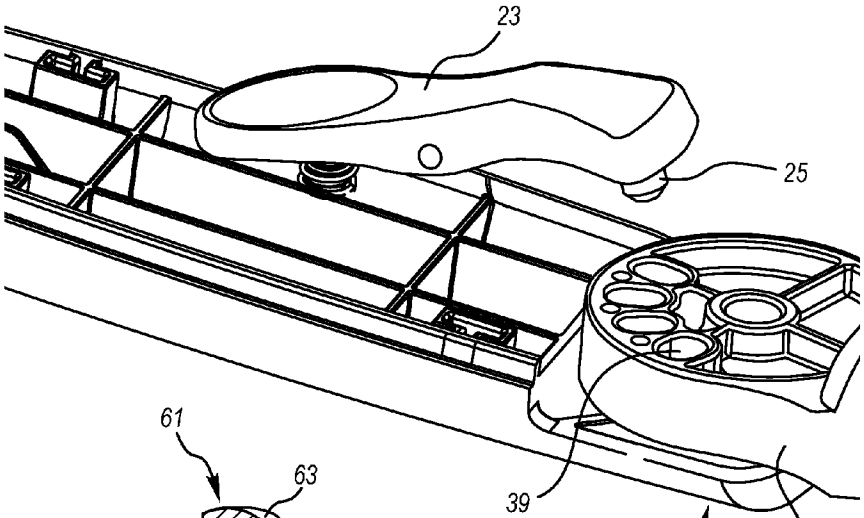
FIG. 10 is a top, left broken-away perspective view of the adjustable holder assembly of FIG. 1 with the top handle housing removed to show the interaction of a variation of a push button with a variation of an articulating arm.

For the exemplary purposes of this disclosure, FIG. 10 shows a top, left broken-away perspective view of adjustable holder assembly 1 with top handle housing 12 removed to show the interaction of a variation of a push button with a variation of an articulating arm. Push button 23 and articulating arm 33 are similar to push button 22 and articulating arm 30 as previously described. The principal difference is that push button 23 includes projection 25 and articulating arm 33 includes end 35 that defines radial holes 39 in a top surface thereof for engaging with the projection 25.

Figure 11:
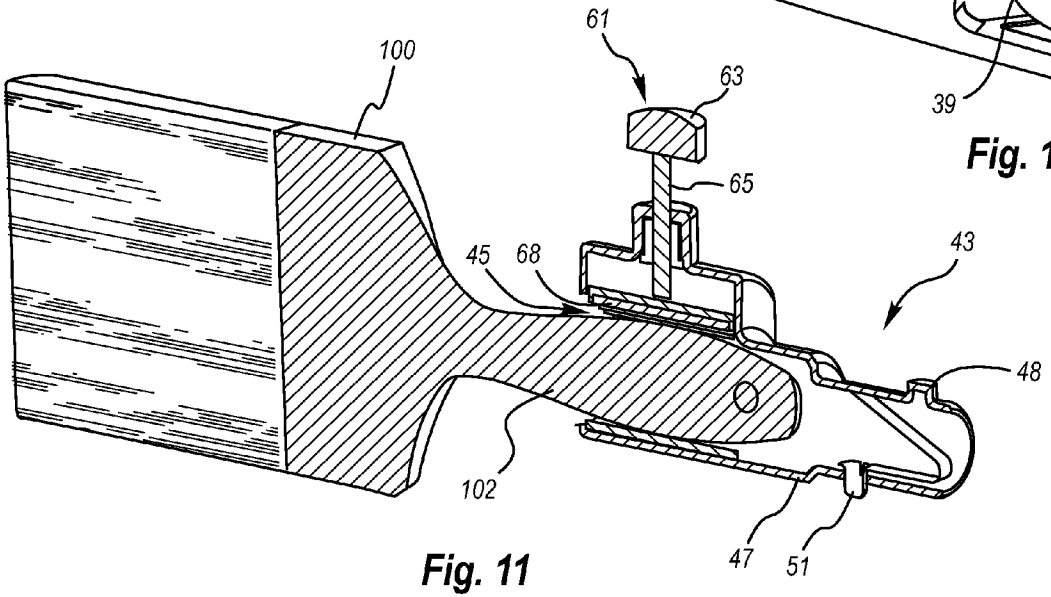
FIG. 11 is a cross-sectional view of the adjustable holder system of FIG. 2 showing a variation of a painting tool handle housing of the adjustable holder assembly of FIG. 1.

For the exemplary purposes of this disclosure, FIG. 11 shows a cross-sectional view of a variation of a painting tool handle housing of adjustable holder assembly 1. Painting tool handle housing 43 is similar to painting tool handle housing 40 as previously described. The principal difference is that painting tool handle housing 43 includes enclosed receiver 45, sleeved end 47, retaining button 48, V-shaped snap button 51, and holder assembly 61 including knob 63, screw 65 and engaging member 68 with grooves and ridges, the geometry of which retains the handles from rotating. Painting tool handle housing 43 holds handles of painting tools vertically, which provides an upright narrow profile.

Further implementations are within the CLAIMS.

Specifications, Materials, Manufacture, Assembly

It will be understood that implementations are not limited to the specific components disclosed herein, as virtually any components consistent with the intended operation of an adjustable holder assembly implementation may be utilized. Accordingly, for example, although particular components and so forth, are disclosed, such components may comprise any shape, size, style, type, model, version, class, grade, measurement, concentration, material, weight, quantity, and/or the like consistent with the intended operation of an adjustable holder assembly implementation. Implementations are not limited to uses of any specific components, provided that the components selected are consistent with the intended operation of an adjustable holder assembly implementation.

Accordingly, the components defining any an adjustable holder assembly implementation may be formed of any of many different types of materials or combinations thereof that can readily be formed into shaped objects provided that the components selected are consistent with the intended operation of an adjustable holder assembly implementation. For example, the components may be formed of: rubbers (synthetic and/or natural) and/or other like materials; glasses (such as fiberglass), carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, spring steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Various adjustable holder assembly implementations may be manufactured using conventional procedures as added to and improved upon through the procedures described here. Some components defining adjustable holder assembly implementations may be manufactured simultaneously and integrally joined with one another, while other components may be purchased pre-manufactured or manufactured separately and then assembled with the integral components.

Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a rivet, a pin, and/or the like), wiring, any combination thereof, and/or the like for example, depending on, among other considerations, the particular material forming the components.

It will be understood that the assembly of adjustable holder assembly implementations are not limited to the specific order of steps as disclosed in this document. Any steps or sequence of steps of the assembly of adjustable holder assembly implementations indicated herein are given as examples of possible steps or sequence of steps and not as limitations, since various assembly processes and sequences of steps may be used to assemble adjustable holder assembly implementations.

Use

Implementations of adjustable holder assemblies are particularly useful in overhead painting and touch up applications as previously explained and adjust to the surface configuration and access thereto. Implementations allow for even the use of extension rods or poles to reach distant surfaces. However, implementations are not limited to uses relating to overhead and other distance applications. Rather, any description relating to these applications is for the exemplary purposes of this disclosure, and implementations may also be used in a variety of other applications with similar results. For example, an adjustable holder assembly can be used for close up surfaces as well without an extension pole to provide the painter with another way to hold a brush for example, especially in a consistent angle and/or rotation with respect to the painting surface. As another example, an adjustable holder assembly can be used with deck staining tools, window cleaning equipment, concrete tools, brooms, and other devices with handles.

In describing the operation and use of adjustable holder assembly implementations further, and for the exemplary purposes of this disclosure, reference is now made to FIGS. 1-2, 3-4, and 12. An paint brush holder system is depicted including adjustable paint brush assembly 1 and paint brush 100.

Paint brush 100 may be installed by removably retaining handle 102 of brush 100 at least partially in receiver 42 of housing 40 by assembly 60. Specifically, brush knob 62 is rotated to adjust adjustment knob screw 64 which tightens brush pad 66 disposed within channel 42 of brush housing 40 against brush handle 102. Brush pad 66 forces handle 102 against ribbed surface 44 which keeps handle 102 securely and removably held in place and from rotating.

In operation, both angular and rotational movement is provided by adjustable paint brush assembly 1. Articulating arm 30 can be angularly displaced with rocker switch 22 and/or handle housing 40 rotated with snap button 50. Both of these adjustments enable a painter to customize the positioning of adjustable paint brush assembly 1 based upon the configuration of the surface to be painted and the access to that surface.

Figure 2:
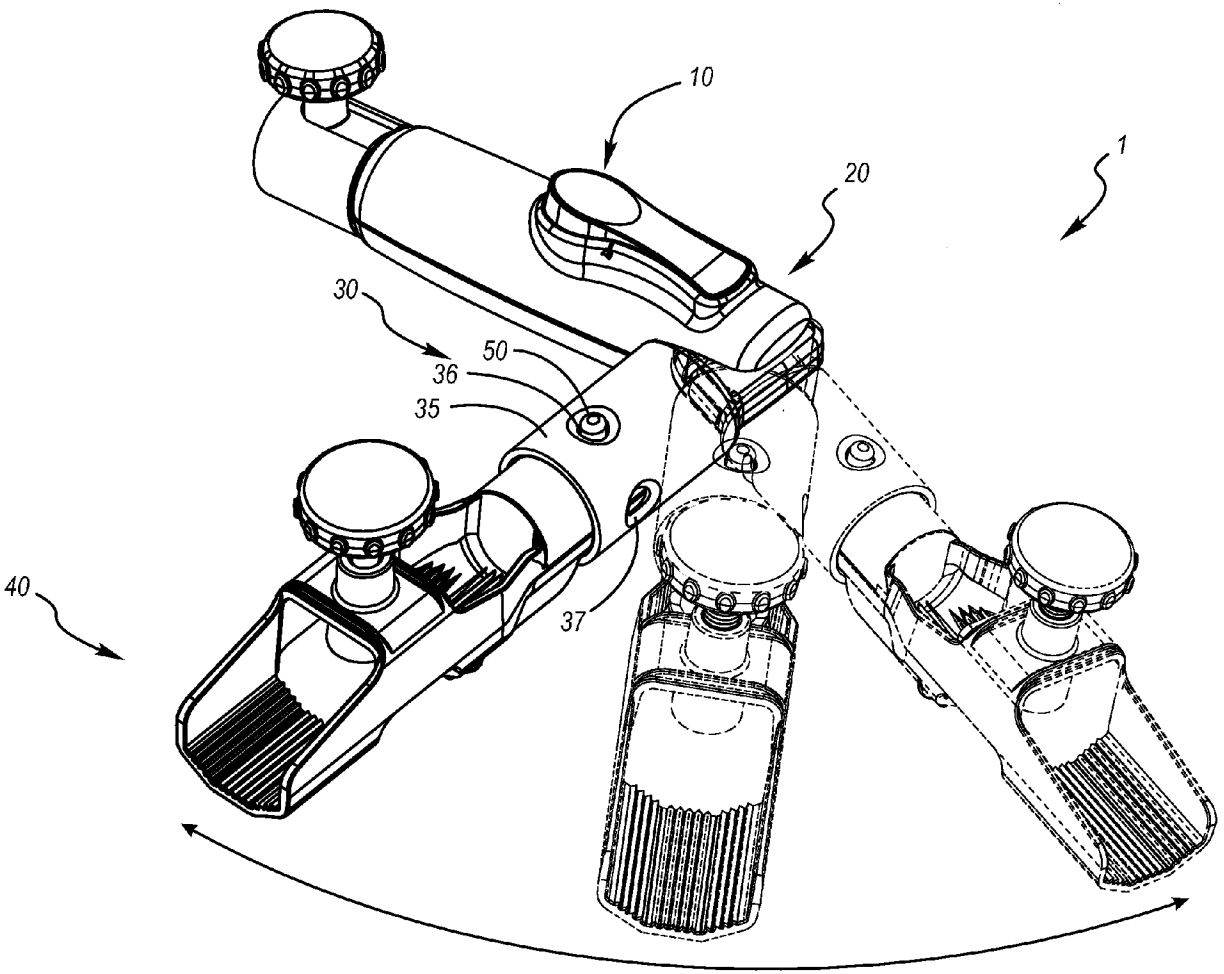
FIG. 2 is a top, left perspective view of the adjustable holder assembly of FIG. 1 showing various articulated positions.
Figure 12:
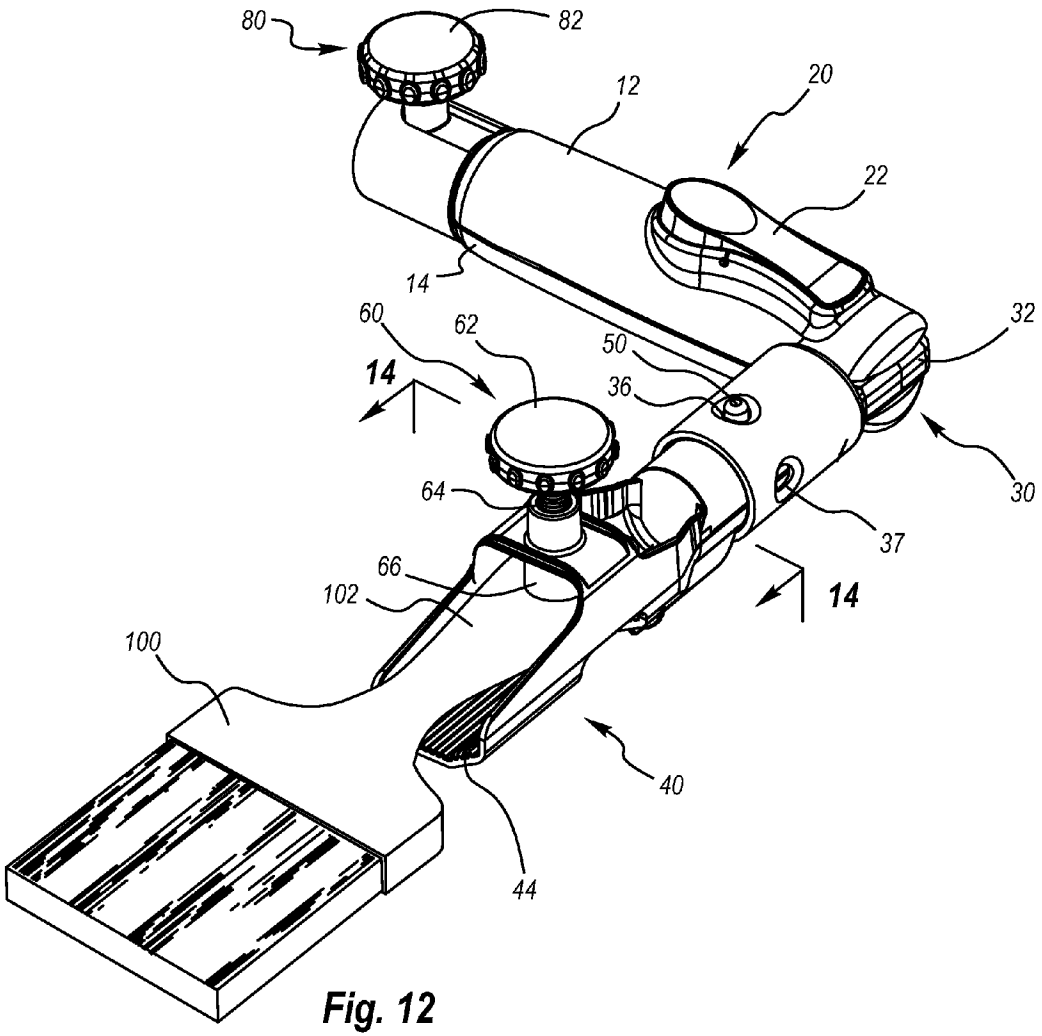
FIG. 12 is a FIG. 2 is a top, left perspective view of the adjustable holder system of FIG. 1 including the adjustable holder assembly of FIG. 1 in a fourth articulated position removably coupled with a painting tool.

FIGS. 1-2 and 12 illustrate the articulated or positional movement of adjustable holder assembly 1. Push button trigger 22 removably engages with notches 34 in an edge of adjustable end 32 of articulating arm 30 so that the arm 30 can be moved and locked in four different positions between 0 to 90 degrees with respect to a longitudinal axis of holder assembly 1. Stopping surfaces 31 and 33 prevent further articulation of articulation arm 30 as they abut the bottom surface of the through channel shaped recess formed by the proximal ends of housings 12 and 14.

Referring to FIG. 1, in an initial or normal position, articulating arm 30 is aligned along the longitudinal axis of handle assembly 10. Locking plate 24 of push button trigger 22 is engaged with the notch 34 corresponding to 0 degrees to hold articulating arm 30 in this particular adjustment position.

Turning to FIG. 2, from the initial position, handle assembly 10 can be grasped by a painter and articulating arm 30 can be angularly displaced using push button trigger 22. Push button trigger 22 can be depressed and released so that locking plate 24 of push button trigger 22 engages with notches 34 in an edge of adjustable end 32 of articulating arm 30 so that the arm 30 can be moved and locked in the remaining three different adjustment positions, 30 degrees, 60 degrees, and 90 degrees.

Such angular movement allows a painter to adjust the painting tool handle housing 40 and hence a painting tool to positions between 0 and 90 degrees. This allows the painter to angularly position and adjust a painting tool to facilitate application of paint to a surface.

FIGS. 3-4 and 12-13 illustrate the rotational movement of adjustable holder assembly 1. Painting tool handle housing 40 is coupled to articulating arm 30. Sleeved end 46 which defines through a surface thereof opposing and offset through holes 47 and 48 as well as defines an inward directing cavity for receiving therein snap button 50 is inserted into sleeved end 35 of articulating arm 30. Snap button 50 rotationally couples articulating arm 30 to painting tool handle housing 40. Snap button 50 allows painting tool handle housing 40 to be rotationally adjusted around a longitudinal axis of holder assembly 1 to any position from 0 degrees to 90 degrees (and hence a painting tool from a horizontal orientation to a vertical orientation for example). As depicted, snap button 50 can allow painting tool handle housing 40 to be rotationally adjusted to two positions—0 degrees and 90 degrees.

Figure 3:
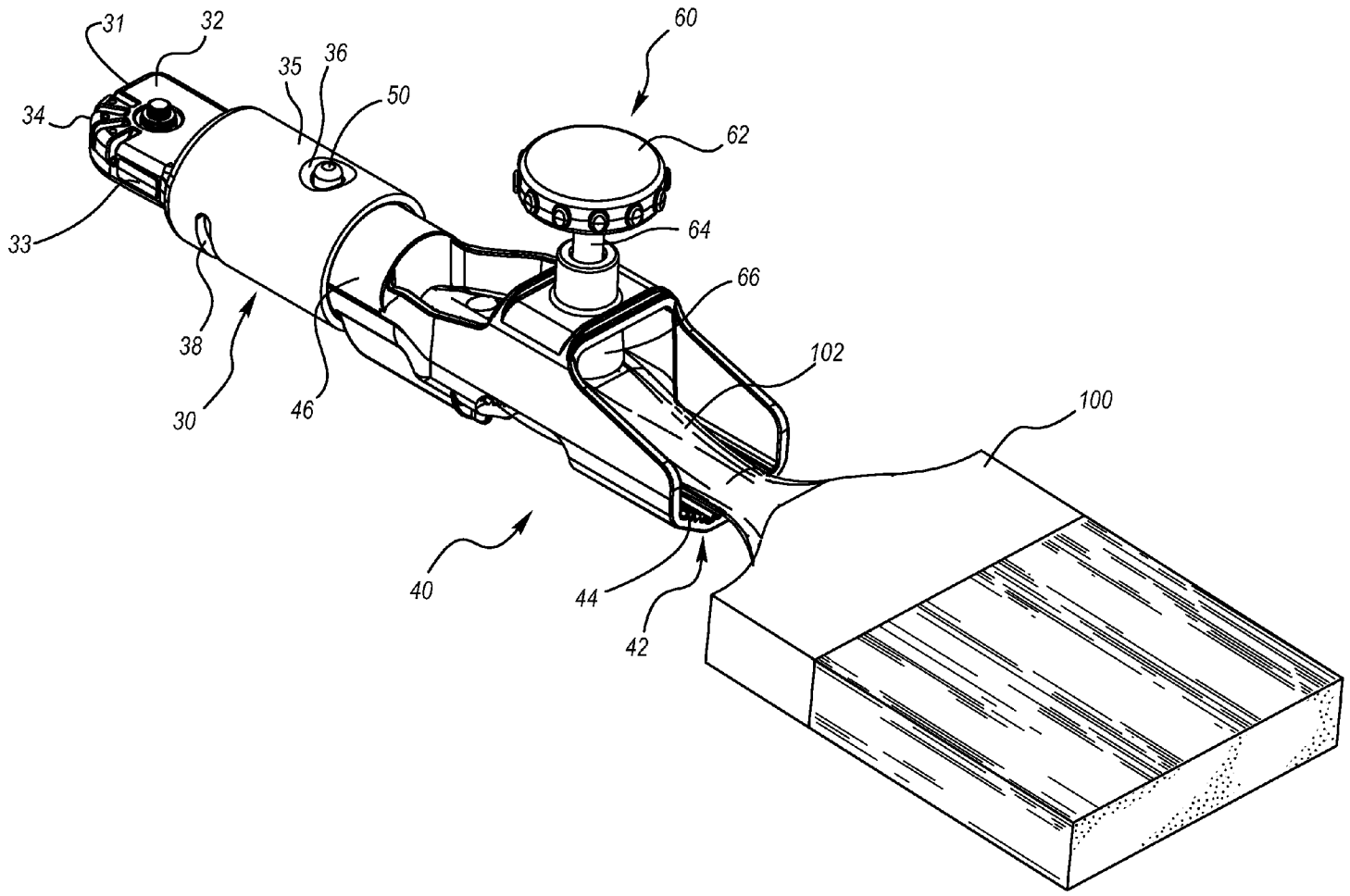
FIG. 3 is a top, left perspective view of an implementation of an adjustable holder system for painting tools including the adjustable holder assembly of FIG. 1 in a first rotated position removably coupled with a painting tool.
Figure 13:
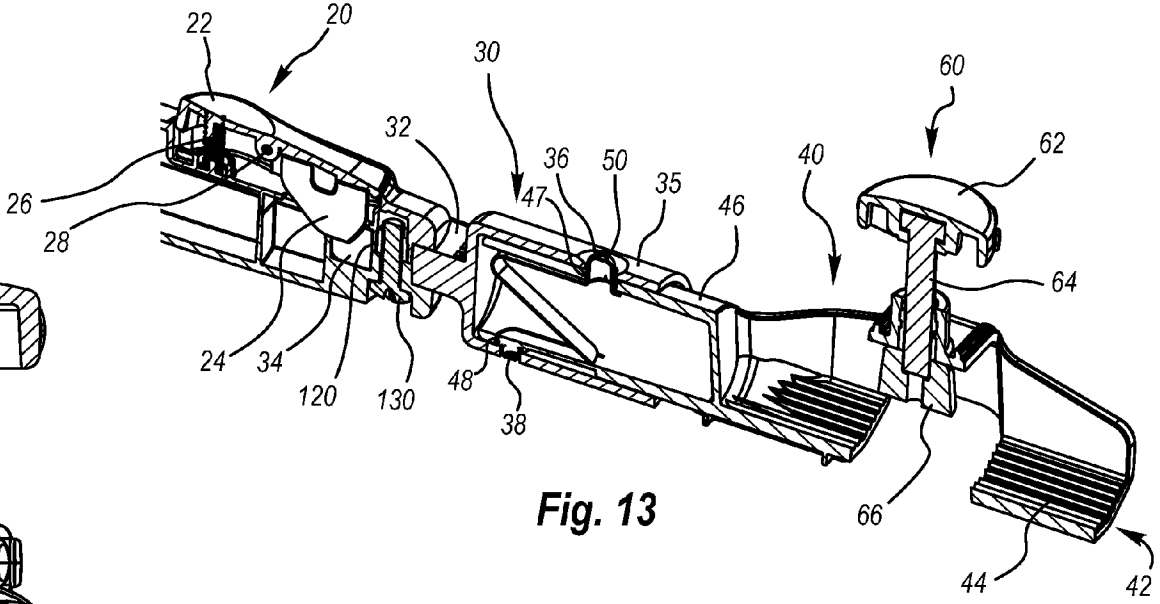
FIG. 13 is a cross-sectional view taken along line 13-13 of FIG. 1 showing the interaction of the rocker switch assembly with the articulating arm in a first articulated position and the interaction of the articulating arm with the painting tool handle housing in a first rotated position.
Figure 14:
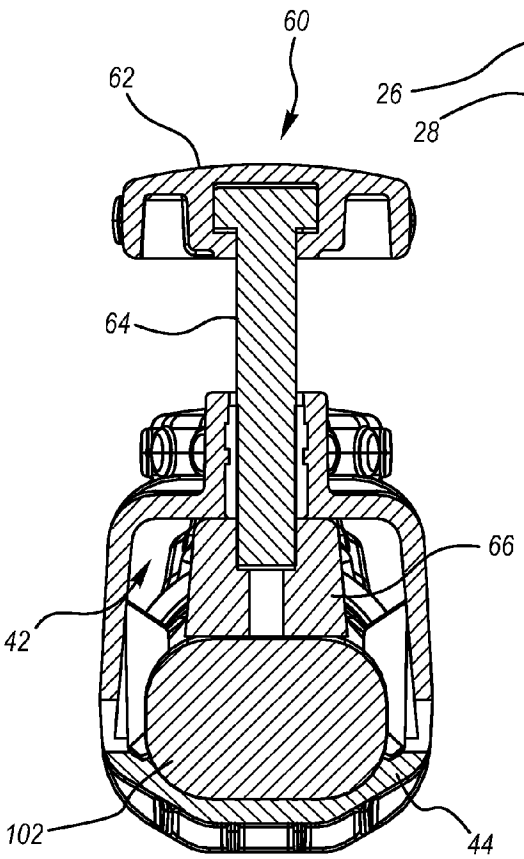
FIG. 14 is a cross-sectional view taken along line 14-14 of FIG. 12 showing the interaction of the handle of the painting tool within the painting tool handle housing.

Referring to FIGS. 3 and 12-13, in an initial or normal position, painting tool handle housing 40 is in the 0 degree position and paint brush 100 is in a horizontal orientation. The hemispherical projections of snap button 50 are removably engaged through the corresponding through holes 47 and 48 and their respective corresponding slot 38 and hole 36.

Turning to FIG. 4, from the initial position, handle assembly 10 and/or articulating arm 30 can be grasped by a painter and handle housing 40 rotated around articulating arm 30 to the second or 90 degree position so that paint brush 100 is in a vertical orientation. The painter depresses the hemispherical projection of snap button 50 currently engaged in hole 36 so that it can engage into hole 37. Retention slot 38 functions as a guide as handle housing 40 is rotated. That is, the other hemispherical projection slides along in slot 38 and allows for consistent engagement of the other hemispherical projection from hole 36 to hole 37 as housing 40 is rotated with respect to articulating arm 30. There is no guesswork by a painter or "finding" a hole. Retention slot 38 also by its configuration provides a stop at each end that corresponds to the locations of holes 36 and 37. That is, when the hemispherical projection that is sliding along in retention slot 38 reaches one end of slot 38, the hemispherical projection at the other end of snap button 50 is automatically aligned with the hole 36; when it reaches the other end of slot 38 the other projection is automatically aligned with the other hole 37.

Such rotational movement allows a painter to adjust the painting tool handle housing 40 and hence a painting tool to positions between 0 and 90 degrees. This allows the painter to rotationally position and adjust (in addition to angularly positioning and adjusting) a painting tool to facilitate application of paint to a surface, such as remote overhead trim and corners and the like.

Thus, implementations may have a number of advantages, some of which are summarized as follows. Sophisticated, secure locking mechanisms hold virtually all sizes and types of professional paintbrushes and prevent brush slippage while providing for easy adjustment. Construction is designed to be lightweight, strong, easy to clean, and impervious to harsh paints, varnishes, stains, and solvents. Adjustability is provided for all hard to reach painting jobs, from eaves to decks. No adaptors are required to lock onto all professional extension poles.

In places where the description above refers to particular implementations, it should be readily apparent that a number of modifications may be made without departing from the spirit thereof and that these implementations may be alternatively applied. The accompanying CLAIMS are intended to cover such modifications as would fall within the true spirit and scope of the disclosure set forth in this document. The presently disclosed implementations are, therefore, to be considered in all respects as illustrative and not restrictive, the scope of the disclosure being indicated by the appended CLAIMS rather than the foregoing DESCRIPTION. All changes that come within the meaning of and range of equivalency of the CLAIMS are intended to be embraced therein.

The invention claimed is:

1. An adjustable holder assembly for removably holding, articulating, and rotating painting tools comprising:

a handle assembly comprising a top handle housing coupled to a bottom handle housing, wherein proximal ends of the top and the bottom handle housings together form a through channel shaped recess and distal free ends of the top and the bottom handle housings together form an inward directing cavity for receiving therein an end of an extension pole;

a sleeve that slides over a coupling joint of distal ends of the top and the bottom handle housings and an extension pole to help keep that joint secure and the distal ends of the top and the bottom handle housings from separating away from each other when an end of an extension pole is coupled therein;

an articulating arm pivotally coupled to a proximal end of the handle assembly configured to allow both the articulating arm and a tool handle housing to be simultaneously angularly adjusted from a longitudinal axis of the holder assembly to any position from 0 degrees to 90 degrees, the articulating arm comprising:

an adjustable end defining a central through hole and a rounded corner with a plurality of notches defined radially in and edge thereof with respect to the central through hole; and a first sleeved end defining a first inward directing cavity for both removably and rotatably receiving therein a second sleeved end of a tool handle housing;

the tool handle housing configured to removably secure a handle of a painting tool at least partially therein, the tool handle housing removably coupled to the articulating arm, the tool handle housing comprising:

a second sleeved end removably and rotatably inserted into the sleeved end of the articulating arm such that the tool handle housing can be rotationally adjusted around a longitudinal axis of the holder assembly to any position from 0 degrees to 90 degrees; and a receiver end defining a channel; and an adjustment assembly coupled to a top of the receiver end, the adjustment assembly comprising an engaging member in the channel to removably secure a handle of a painting tool at least partially within the receiver end.

2. The assembly of claim 1 further comprising a rocker switch assembly comprising:

a push button trigger coupled in a recess defined in a top surface of the top handle housing via a spring pin;

a spring coupled beneath a distal end of the push button trigger that biases the push button trigger in an engaged position with the articulating arm to prevent inadvertent adjustment; and a locking plate coupled to an underside of a proximal end of the push button trigger, the locking plate removably engaging with the plurality of notches as the push button trigger depresses and releases the spring to adjust and then hold articulating arm in different adjustment positions.

3. The assembly of claim 1, wherein the adjustable end of the articulating arm is sandwiched between the proximal ends of the top and the bottom handle housings within the through channel shaped recess.

4. The assembly of claim 3 wherein the adjustable end of the articulating arm is substantially rectangular in shape and further comprises first and second flat stopping surfaces on either side of the rounded corner configured to prevent further articulation of the articulation arm as they abut a bottom surface of the through channel shaped recess formed in the proximal end of the handle assembly.

5. The assembly of claim 1 further comprising an adjustment assembly coupled to the top handle housing for securing an end of an extension pole within the inward directing cavity formed by the distal free ends of the top and the bottom handle housings.

6. The assembly of claim 1 wherein the handle assembly comprises a generally cylindrical configuration.

7. The assembly of claim 1 the plurality of notches comprises at least four notches configured to allow painting tool handle housing to be angularly adjusted to at least a 0 degree position, a 30 degree position, a 60 degree position, and a 90 degree position, respectively.

8. The assembly of claim 1 wherein the receiver end comprises both a partially open top and a partially open bottom.

9. The assembly of claim 1 wherein the channel comprises a U-shaped cross-sectional shape with angled internal corners.

10. The assembly of claim 1 further comprising a plurality of surface ridges and grooves on at least a bottom surface of the channel to securely grip handles to keep them in position and prevent them from slipping or turning.

11. The assembly of claim 10 wherein the surface ridges and grooves are aligned longitudinally with the channel.

12. An adjustable holder assembly for removably holding, articulating, and rotating painting tools comprising:

a handle assembly;

an articulating arm pivotally coupled to a proximal end of the handle assembly configured to allow both the articulating arm and a tool handle housing to be simultaneously angularly adjusted from a longitudinal axis of the holder assembly to any position from 0 degrees to 90 degrees, the articulating arm comprising:

an adjustable end defining a central through hole and a rounded corner with a plurality of notches defined radially in and edge thereof with respect to the central through hole; and a first sleeved end defining a first inward directing cavity for both removably and rotatably receiving therein a second sleeved end of a tool handle housing;

the tool handle housing configured to removably secure a handle of a painting tool at least partially therein, the tool handle housing removably coupled to the articulating arm, the tool handle housing comprising:

a second sleeved end removably and rotatably inserted into the sleeved end of the articulating arm such that the tool handle housing can be rotationally adjusted around a longitudinal axis of the holder assembly to any position from 0 degrees to 90 degrees; and a receiver end defining a channel; and an adjustment assembly coupled to a top of the receiver end, the adjustment assembly comprising:

an engaging member in the channel to removably secure a handle of a painting tool at least partially within the receiver end; and a handle pad disposed within the channel and coupled to an adjustment knob via an adjustment screw, the handle pad configured to removably retain handles of tools at least partially within the channel.

13. An adjustable holder assembly for removably holding, articulating, and rotating painting tools comprising:

a handle assembly;

an articulating arm pivotally coupled to a proximal end of the handle assembly configured to allow both the articulating arm and a tool handle housing to be simultaneously angularly adjusted from a longitudinal axis of the holder assembly to any position from 0 degrees to 90 degrees, the articulating arm comprising:

an adjustable end defining a central through hole and a rounded corner with a plurality of notches defined radially in and edge thereof with respect to the central through hole; and a first sleeved end:

defining a first inward directing cavity for both removably and rotatably receiving therein a second sleeved end of a tool handle housing; and defining through a surface thereof first and second adjustment through holes and a retention through slot;

the tool handle housing configured to removably secure a handle of a painting tool at least partially therein, the tool handle housing removably coupled to the articulating arm, the tool handle housing comprising:

a second sleeved end removably and rotatably inserted into the sleeved end of the articulating arm such that the tool handle housing can be rotationally adjusted around a longitudinal axis of the holder assembly to any position from 0 degrees to 90 degrees, the second sleeved end defines through a surface thereof opposing and offset through holes and defines a second inward directing cavity; and a receiver end defining a channel;

a snap button configured to couple the articulating arm to the tool handle housing, the snap button comprising a resilient, Z-shaped member having two opposing and offset from one another hemispherical projections, the snap button inserted and received into the inward directing cavity defined by the second sleeved end such that the hemispherical projections are removably engaged through the corresponding opposing and offset through holes and the corresponding retention through slot and one of the first and second adjustment through holes; and an adjustment assembly coupled to a top of the receiver end, the adjustment assembly comprising an engaging member in the channel to removably secure a handle of a painting tool at least partially within the receiver end.

* * * * *